United States Patent [19]

Swanberg

[11] 4,264,006

[45] Apr. 28, 1981

[54] SHADOW BOX WITH IMPROVED PLATFORM ASSEMBLY

[75] Inventor: Robert H. Swanberg, Montvale, N.J.

[73] Assignee: Union Camp Corporation, Wayne, N.J.

[21] Appl. No.: 98,635

[22] Filed: Nov. 29, 1979

[51] Int. Cl.[3] ..... B65D 5/50; B65D 5/48; B65D 25/00

[52] U.S. Cl. ..... 206/45.14; 206/45.19; 206/45.31; 229/27; 229/39 R

[58] Field of Search ..... 206/45.14, 45.19, 45.31; 229/27, 39 R

[56] References Cited

U.S. PATENT DOCUMENTS

| | | | |
|---|---|---|---|
| 3,360,117 | 12/1967 | Powers et al. | 206/45.14 |
| 3,669,253 | 6/1972 | Hanko | 206/45.14 |
| 3,680,687 | 8/1972 | D'Alessio | 206/45.14 |
| 4,037,717 | 7/1977 | Roccaforte | 206/45.14 |

*Primary Examiner*—William T. Dixson, Jr.
*Attorney, Agent, or Firm*—Kane, Dalsimer, Kane, Sullivan and Kurucz

[57] ABSTRACT

This disclosure is of a shadow box for retaining and displaying an article with an improved built-up platform assembly to support the base of the article packaged in the box, which assembly absorbs shocks to the package and prevents the article from loosening and falling out of the box during shipment, handling and display.

5 Claims, 5 Drawing Figures

FIG.5
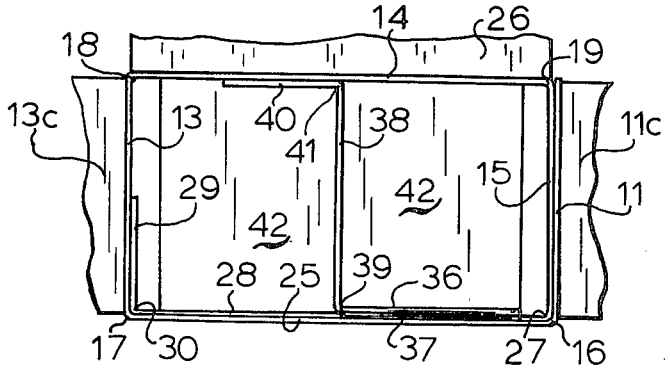
FIG.4
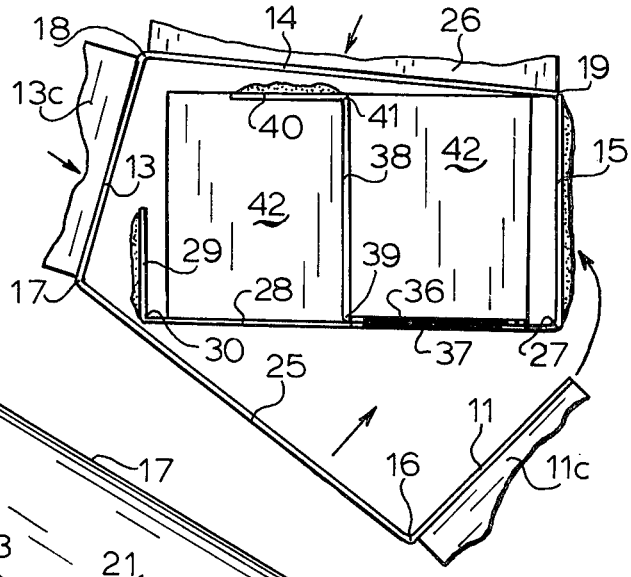
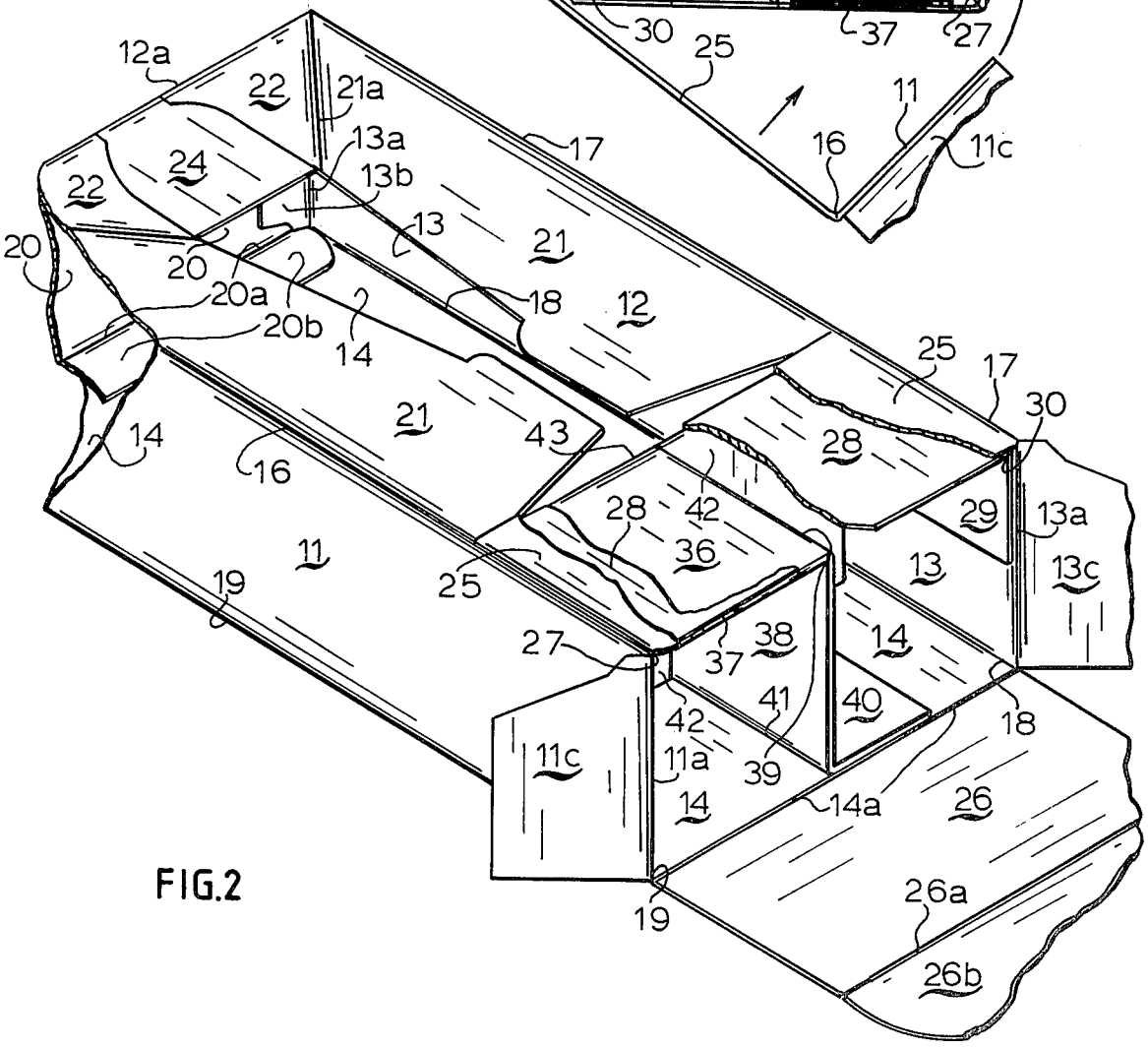
FIG.2

SHADOW BOX WITH IMPROVED PLATFORM ASSEMBLY

BACKGROUND OF THE INVENTION

1. Field of the Invention

The invention relates to an improvement in folding cartons and more particularly to a shadow box embodying a built-up platform to support the base of the product packaged in the box, to absorb shocks to the package during shipment and to hold the product from falling out of the package during shipment, handling and display.

2. Brief Description of the Prior Art

Shadow boxes with platforms to support the product packaged in the boxes are old and well known. However, the platform of the present invention and the various panels which are folded and secured within the box to support the platform are not disclosed in prior shadow boxes and are novel.

SUMMARY OF THE INVENTION

The invention covers a shadow box formed from a precut and prescored blank which box, when erected and closed with a product inserted in the box, has interconnected side panels, a back panel, a series of front frame panels folded inwardly to form a frame for displaying the product packaged in the box, top and bottom closures, a platform spaced from the bottom closure to support the base of the said product and a platform assembly for supporting said platform, the said platform and platform assembly comprising:

a first supporting panel to which the platform assembly is connected, said supporting panel being connected at one end to one side panel along a hinge line and at the other end to the opposite side panel along a hinge line, the said supporting panel being subtantially parallel to and between the front and back panels of the box;

a second supporting panel hinged along a substantial portion of the bottom edge of the first supporting panel and otherwise unsecured so that it is free to flex, the said second supporting panel having a height approximately equal to the height of the first supporting panel and being reverse folded to lie against the surface of the first supporting panel;

a strut panel having a height approximately equal to the height of the first supporting panel and a length equal to the distance from the first supporting panel to the back panel of the box, the said strut panel being connected at one end to the second supporting panel along a hinge line at the inner end of and normal to the hinge line connecting the first and second supporting panels and at the opposite end along a hinge line on an adhesive flap secured to the back panel;

a platform panel connected along a hinge line to the top of the second supporting panel, the said platform panel, when the base of the product rests on the platform, being normal to the side and back panels of the box and of a size to receive the said base of the product;

whereby the product will be retained against release during shipment, handling and display and will be able to absorb shocks without damage to the box or product.

BRIEF DESCRIPTION OF THE DRAWINGS

In the drawings:

FIG. 2 is a perspective view of the blank of FIG. 1 set up with the bottom closure flaps open and the front panel partially broken away.

FIG. 4 is an end view of the shadow box of FIG. 2 with the panels partially folded into position; and FIG. 5 is an end view of the shadow box of FIG. 2.

DESCRIPTION OF THE PREFERRED EMBODIMENT

Figure 3:
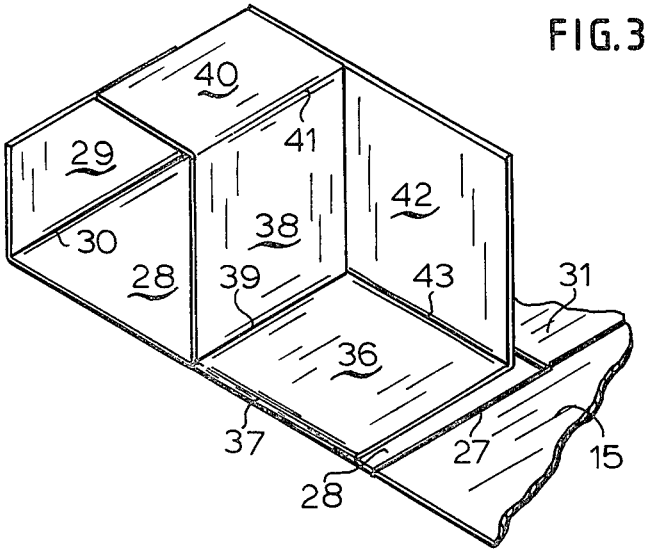
FIG. 3 is a partially assembled view of the platform assembly.
Figure 1:
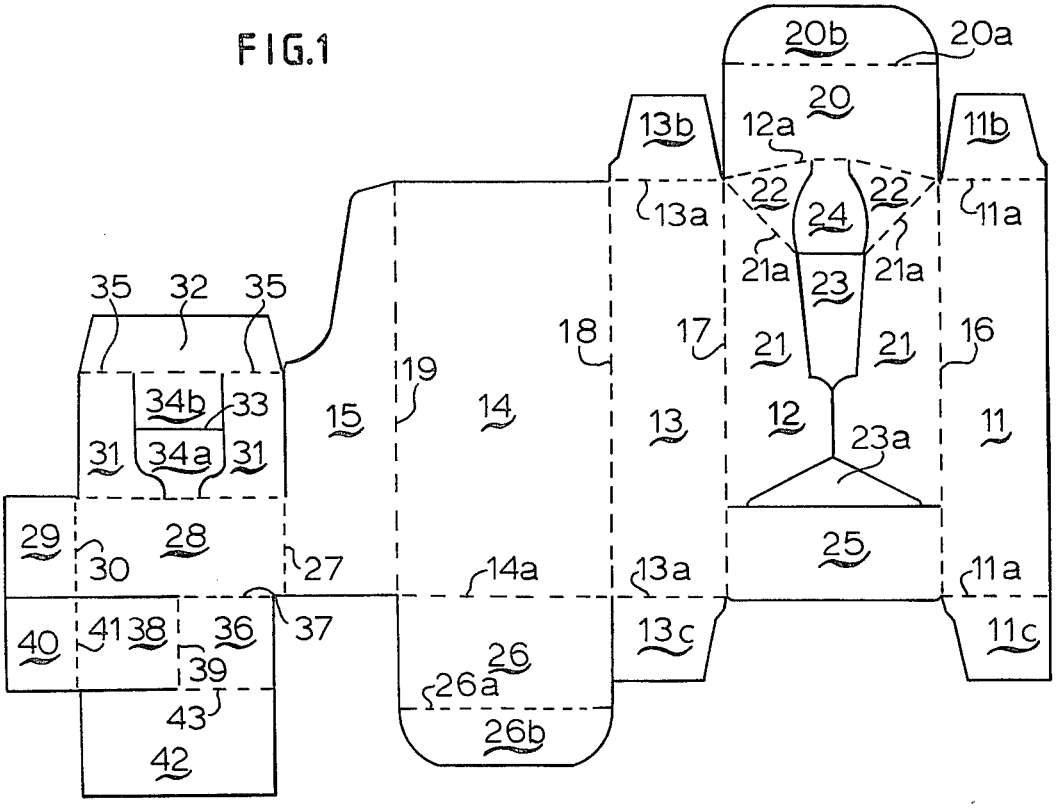
FIG. 1 is a plan view of the blank for the shadow box embodying the platform assembly of the present invention.

Referred to the drawings, there is shown in FIG. 1 a blank 10 of sheet material such as paperboard used for folding cartons, of a weight suitable for the type of carton to be constructed. The blank 10 consists of first side panel 11, front panel 12, second side panel 13, back panel 14 and inner side panel 15, which panels are connected respectively along hinge score lines 16, 17, 18 and 19. Connected to the first side panel 11 along hinge score lines **11*a* are top and bottom side closure flaps 11*b* and 11*c*. Similarly, there are connected to the secnd side panel 13 along hinge score lines 13*a* top and bottom side closure flaps 13*b* and 13*c***.

Connected to the top of the front panel 12 along hinge score line **12*a* is a top panel 20 to which is connected a back closure flap 20*b* along hinge score line 20*a*. The front panel 12 is scored along oblique hinge score lines 21*a* to provide side frame panels 21 and top frame panels 22. Such front panel 12 is cut and cut out in the center area to provide openings 23 and 23*a*, a top inner flap 24 and a front base panel 25. The opening 23** is of a size and dimension to receive and hold the article to be packaged, such as a bottle or container, when the frame panels are folded inwardly to form a frame for such article. This frame permits the article to be so displayed that the labels can be read and the appearance of the article will be enhanced.

Connected to the bottom of the back panel 14 along hinge score line **14*a* is a bottom panel 26 to which is connected a front closure flap 26*b* along hinge score line 26*a*. Connected to the inner side panel 15 along a hinge score line 27 is one end of a first supporting panel 28. The other end of the first supporting panel is provided with an adhesive flap 29 connected thereto along a hinge score line 30. When the box is set up the adhesive flap 29 will be secured by adhesive to the second side panel 13**.

Connected to the top of the first supporting panel 28 when the box is set up is an inner base assembly which is cut and scored to provide inner side frame members 31, an inner cross frame member 32, a central cut out 33 sized to hold the product packaged in the box, hole flaps **34*a* and 34*b*, and a hinge score line 35**. This inner base assembly forms part of the inner frame for the product.

Connected to the bottom of the first supporting panel 28 when the box is set up is a platform assembly comprising:

(a) a second supporting panel 36 connected along a hinge score line 37 to a substantial portion of the bottom edge of the first supporting panel and having a height approximately equal to the height of the first supporting panel, such second supporting panel 36 being adapted to be reverse folded to lie against the surface of the first supporting panel 28 when the box is set up, such second supporting panel being otherwise unsecured so that it is free to flex;

(b) a strut panel 38 connected at one end to the second supporting panel 36 along a hinge score line 39 at the inner end of and normal to the hinge line 37 and at the other end to an adhesive flap 40 along a hinge score line 41, which adhesive flap is adapted to be secured to the back panel 14 when the box is set up, the said strut having a height approximately equal to the height of the first supporting panel and a length equal to the distance from the first supporting panel 28 to the back panel 14 of the box; and (c) a platform panel 42 connected along a hinge score line 43 to the top of the second supporting panel 36. The platform panel 42 can extend all the way across the carton or be of smaller size. However, it should be of sufficient size to provide an ample support for the base of the article packaged in the carton.

The blank is glued and folded together by the carton manufacturer so that it can be shipped to the user in flat form. Referring to FIG. 1 the platform assembly is reverse folded along the hinge score line 37 so that the portions of such assembly lie against first supporting panel 28. Adhesive is applied to the top surface of adhesive flap 40 and the platform assembly is reverse folded along the hinge score line 27 so that the flap 40 is bonded to back panel 14. Adhesive is applied to the surface of adhesive flap 29 and the blank is reverse folded along the hinge score line 18 so that the flap 29 is bonded to the surface of second side flap 13. Adhesive is applied to the surface of the inner side panel 15 and the blank is reverse folded along the hinge score line 16 so that the first side panel 11 is bonded to surface of the inner side panel 15. FIGS. 2–5, inclusive, show the manner in which the various parts come together during assembly rather than how the carton manufacturer performs the gluing and folding operations.

The user, who will package the article in the carton, receives such cartons in flat form ready for use. He merely pushes the outer fold lines of the carton so that the carton will assume a rectangular shape. The bottom flaps 11*c* and 13*c* are folded inwardly, the bottom panel 26 is folded over such flaps and the flap 26*b* is inserted in place to close the bottom of the carton. The article is inserted into the opening of the front panel 12 so that the base of the article fits in the opening in the inner base assembly and rests on the hole flap 34*a*. It will be seen that the article is supported by the platform panel 42 which is beneath the hole flap 34*a*. Such platform provides a support for the article, but also is adapted by reason of the platform assembly to absorb shocks to the package and article during shipment, handling and display.

The platform 42 gets its main strength from the vertical strut 38. When the product is inserted in the carton the flap 34*a* and platform 42 seat themselves against vertical strut 38, which in turn is supported by panel 36. The panel 36, not being glued fast, is able to flex and therefore receive a shock from dropping and not sustain permanent damage to the supporting member.

The present invention thus provides shadow box with an unusual amount of strength in the platform which is needed for supporting heavy products without collapsing during shipment and before being put on display. This also prevents a product from loosening and falling out while in the box during shipment because such boxes are subject to vibration and dropping during distribution and prior to display.

Those skilled in the art will appreciate that many variations of the above-described embodiment of the invention may be made without departing from the spirit and the scope of the invention.

What is claimed:

1. In a shadow box formed from a precut and prescored blank which box, when erected and closed with a product inserted in the box, has interconnected side panels, a back panel, a series of front frame panels folded inwardly to form a frame for displaying the product packaged in the box, top and bottom closures, a platform to support the base of the said product and a platform assembly for supporting the said platform, the improvement in the said platform and platform assembly comprising:

a first supporting panel to which the platform assembly is connected, said supporting panel being connected along hinge lines to one side panel and at the other end to the opposite side panel, the said supporting panel being substantially parallel to and between the front and back panels of the box;

a second supporting panel hinged along a substantial portion of the bottom edge of the first supporting panel and otherwise unsecured so that it is free to flex, the said second supporting panel having a height approximately equal to the height of the first supporting panel and being reverse folded to lie against the surface of the first supporting panel;

a strut panel having a height approximately equal to the height of the first supporting panel and a length equal to the distance from the first supporting panel to the back panel of the box, the said strut panel being connected at one end to the second supporting panel along a hinge line at the inner end of and normal to the hinge line connecting the first and second supporting panels and at the opposite end to the back panel along a hinge line;

a platform panel connected along a hinge line to the top of the second supporting panel, the said platform panel, when the base of the product rests on the platform, being normal to the side and back panels of the box and of a size to receive the said base of the product;

whereby the product will be retained against release during shipment, handling and display and will be able to absorb shocks without damage to the box or product.

2. The shadow box of claim 1 in which the bottom front frame panel is cut out in the shape of the base of the product, whereby the product will be retained in the recess in the bottom front frame panel.

3. The shadow box of claim 2 in which the cut out is uncut along the base of the bottom front frame panel to provide a base hole flap connected along a hinge line to the said panel, the said base hole flap being folded inwardly to rest on the platform when the product is inserted in the cut out.

4. The shadow box of claim 1 in which the platform extends substantially from one side panel to the opposite side panel.

5. In a flat, collapsed shadow box formed from a precut and prescored blank which box can be erected and closed with a product inserted in the box and has interconnected side panels, a back panel, a series of front framepanels adapted to be folded inwardly to form a frame for displaying the product packaged in the box, top and bottom closures, a platform to support the base of the said product and a platform assembly for supporting the said platform, the improvement in the said platform and platform assembly comprising:

a first supporting panel to which the platform assembly is connected, said supporting panel being connected along hinge lines at one end to one side panel and at the other end to the opposite side panel, the said supporting panel being substantially parallel to and between the front and back panels of the box;

a second supporting panel hinged along a substantial portion of the bottom edge of the first supporting panel and otherwise unsecured so that it will be free to flex, the said second supporting panel having a height approximately equal to the height of the first supporting panel and being reverse folded to lie against the surface of the first supporting panel;

a strut panel having a height approximately equal to the height of the first supporting panel and a length equal to the distance from the first supporting panel to the back panel of the box when the box is erected, the said strut panel being connected at one end to the second supporting panel along a hinge line at the inner end of and normal to the hinge line connecting the first and second supporting panels and at the opposite end to the back panel along a hinge line;

a platform panel connected along a hinge line to the top of the second supporting panel, the said platform panel, when the box is erected and the base of the product rests on the platform, being normal to the side and back panels of the box and of a size to receive the said base of the product;

whereby the product in the box when the box is erected and closed will be retained against release during shipment, handling and display and will be able to absorb shocks without damage to the box or product.

* * * * *